US007121986B1

(12) United States Patent
O'Dowd

(10) Patent No.: US 7,121,986 B1
(45) Date of Patent: Oct. 17, 2006

(54) MARTIAL ARTS DEVICE FOR HOLDING BREAKING BOARDS AND ASSOCIATED METHODS

(76) Inventor: Steven M. O'Dowd, 281 Liverpool Cove, Longwood, FL (US) 32779

( * ) Notice: Subject to any disclaimer, the term of this patent is extended or adjusted under 35 U.S.C. 154(b) by 409 days.

(21) Appl. No.: 10/324,604

(22) Filed: Dec. 20, 2002

Related U.S. Application Data

(60) Provisional application No. 60/343,046, filed on Dec. 20, 2001.

(51) Int. Cl.
*A63B 69/34* (2006.01)

(52) U.S. Cl. ..... 482/83; 482/87

(58) Field of Classification Search ..... 482/83, 482/84–90; D21/662, 665, 722; 2/118; D29/116.1

See application file for complete search history.

(56) References Cited

U.S. PATENT DOCUMENTS

| | | | | | |
|---|---|---|---|---|---|
| 1,015,028 | A | | 1/1912 | Knauss | |
| 4,046,362 | A | | 9/1977 | Spillers | |
| 4,052,056 | A | * | 10/1977 | Friedenthal | 482/83 |
| 4,171,803 | A | * | 10/1979 | Smith | 482/83 |
| 4,572,504 | A | * | 2/1986 | DiBartolo | 482/83 |
| 4,583,730 | A | | 4/1986 | Gecht et al. | |
| 4,732,378 | A | | 3/1988 | LeFebvre et al. | |
| 4,757,990 | A | * | 7/1988 | Dosch | 482/83 |
| 4,776,584 | A | | 10/1988 | Tilley et al. | |
| 4,883,635 | A | * | 11/1989 | Goradesky | 482/83 |
| 5,131,896 | A | * | 7/1992 | Hutchings | 482/83 |
| 5,232,368 | A | * | 8/1993 | Morgia | 434/247 |
| 5,362,289 | A | | 11/1994 | Holt | |
| 5,415,371 | A | * | 5/1995 | Kirchner | 248/316.4 |
| 5,458,551 | A | * | 10/1995 | Shenton | 482/83 |
| 5,567,496 | A | | 10/1996 | Svehaug | |
| 6,149,553 | A | | 11/2000 | Antoszewski | |
| 6,217,490 | B1 | | 4/2001 | Wurtak | |

* cited by examiner

*Primary Examiner*—Lori Amerson
(74) *Attorney, Agent, or Firm*—Allen, Dyer, Doppelt, Milbrath & Gilchrist, P.A.

(57) ABSTRACT

Described are an apparatus and method for a martial arts device for holding at least one breaking board. The device includes a frame having at least four frame members, including two generally parallel and oppositely spaced apart lengthwise members, and two generally parallel and oppositely spaced apart widthwise members. Lateral edges of the frame members form an outside periphery and an inside periphery of the frame, the inside periphery surrounding an inside opening extending through the frame. At least two rabbets are positioned generally spaced apart and opposite each other on the frame members along the inside periphery of the frame for therein receiving edges of a breaking board so as to support the board positioned across the inside opening of the frame, and a plurality of adjustable fasteners is positioned on the frame members adjacent the at least two rabbets for fastening the breaking board on the frame.

39 Claims, 4 Drawing Sheets

FIG. 4.
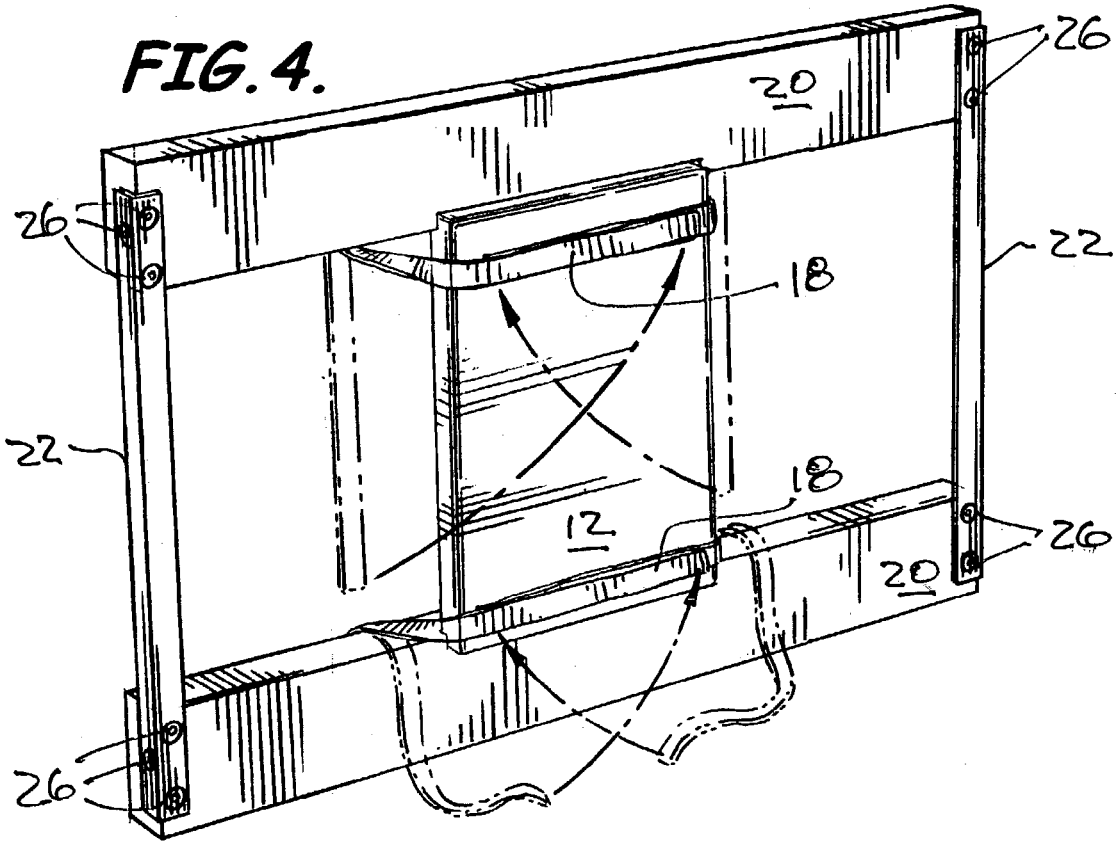
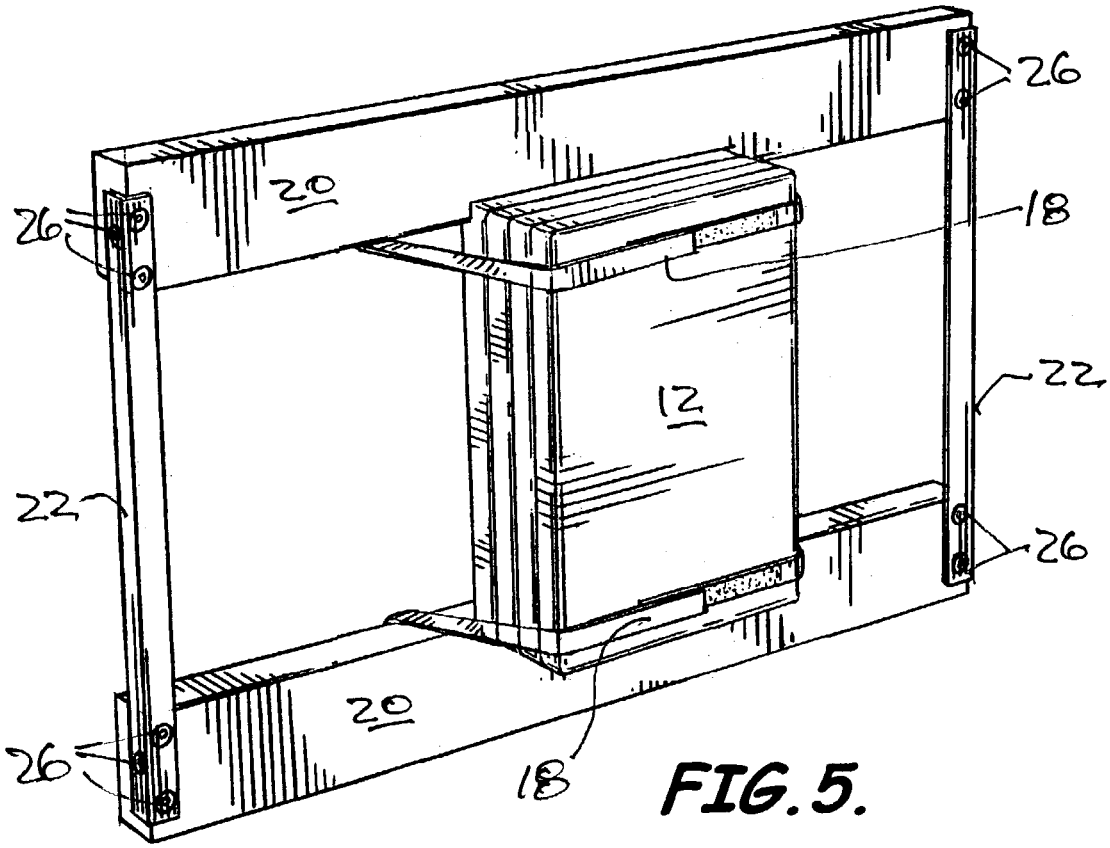
FIG. 5.

MARTIAL ARTS DEVICE FOR HOLDING BREAKING BOARDS AND ASSOCIATED METHODS

RELATED APPLICATION

This application claims priority from co-pending provisional application Ser. No. 60/343,046, which was filed on Dec. 20, 2001, and which is incorporated herein by reference in its entirety.

FIELD OF THE INVENTION

The present invention relates to the field of the martial arts and, more particularly, to a hand-held device for holding boards for breaking, such as during karate exercises or demonstrations.

BACKGROUND OF THE INVENTION

Those skilled in the martial arts understand that the exercise of breaking boards helps the martial artist not only hone his or her skills and increase confidence, but also aids in building the strength necessary for delivering effective blows to an opponent or other target. Accordingly, it is common practice in the martial arts for one or two assistants to hold boards for breaking, while a practitioner takes aim and delivers a blow to the boards.

These exercises are also known to be dangerous and prone to causing injuries not only to the practitioner delivering the blow, but also possibly to the assistants holding the breaking boards. These injuries often occur when a blow is misdirected and lands on the fingers of the assistants holding the board, or on support equipment being used to hold the board. Injuries may also occur when the broken board does not readily clear away from the practitioner's fist, foot, or other body part employed in delivering the blow. For example, with certain types of board support equipment it is possible for the broken edges of the board to close back on the practitioner's fist or foot to thereby cause injury. Additionally, the typical assistant is able to hold approximately about three boards, so that when the breaking boards are held by an assistant, the number of boards to be broken by the practitioner is limited by the hand span of the assistant.

SUMMARY OF THE INVENTION

With the foregoing in mind, the present invention advantageously provides a martial arts device for holding one or more boards for breaking. The device is primarily intended for hand-held use, preferably by two holding assistants. The device is, thus, easily portable and widely adjustable in holding height and orientation to provide many different angles for board breaking practice. The device additionally allows holding multiple boards, so that the martial arts practitioner is no longer limited to the smaller number of boards which an assistant is capable of holding.

The device advantageously also aids in distributing the force of a board breaking blow over a larger area to help reduce impact damage to the hands of holding assistants. It can be appreciated that when assistants are directly holding boards for breaking, the impact force of a blow directed onto those boards will largely be transferred onto the hands of the holders. This transfer of force is known to cause soft tissue damage such as bruising, as well as bone damage, including fractures. Further, as the boards break the held edges of the boards will be forcefully turned in the hands of the assistants, with the probability of causing further injury to the assistants. The device of the present invention helps prevent such injuries.

A preferred martial arts device for holding at least one breaking board comprises a frame, at least two rabbets along the frame, and a plurality of adjustable fasteners. The frame has at least four frame members connected to form the frame, wherein the frame members comprise generally parallel and oppositely spaced apart first and second lengthwise members, and generally parallel and oppositely spaced apart first and second widthwise members, wherein lateral edges of the frame members form an outside periphery and an inside periphery of the frame, the inside periphery surrounding an inside opening extending through the frame. At least two rabbets are positioned generally spaced apart and opposite each other on the frame members along the inside periphery of the frame for therein receiving edges of a breaking board so as to support the board positioned across the inside opening of the frame. A plurality of adjustable fasteners is positioned on the frame members adjacent the rabbets for fastening the breaking board on the frame. Additional embodiments of the invention are further described below.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which:

FIG. 4 illustrates a perspective view of the device of FIG. 1 with a single board in place ready for breaking and showing the function of the fastener straps;

FIG. 5 is a fragmentary perspective showing boards being attached and the function of the fastener straps.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, however, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
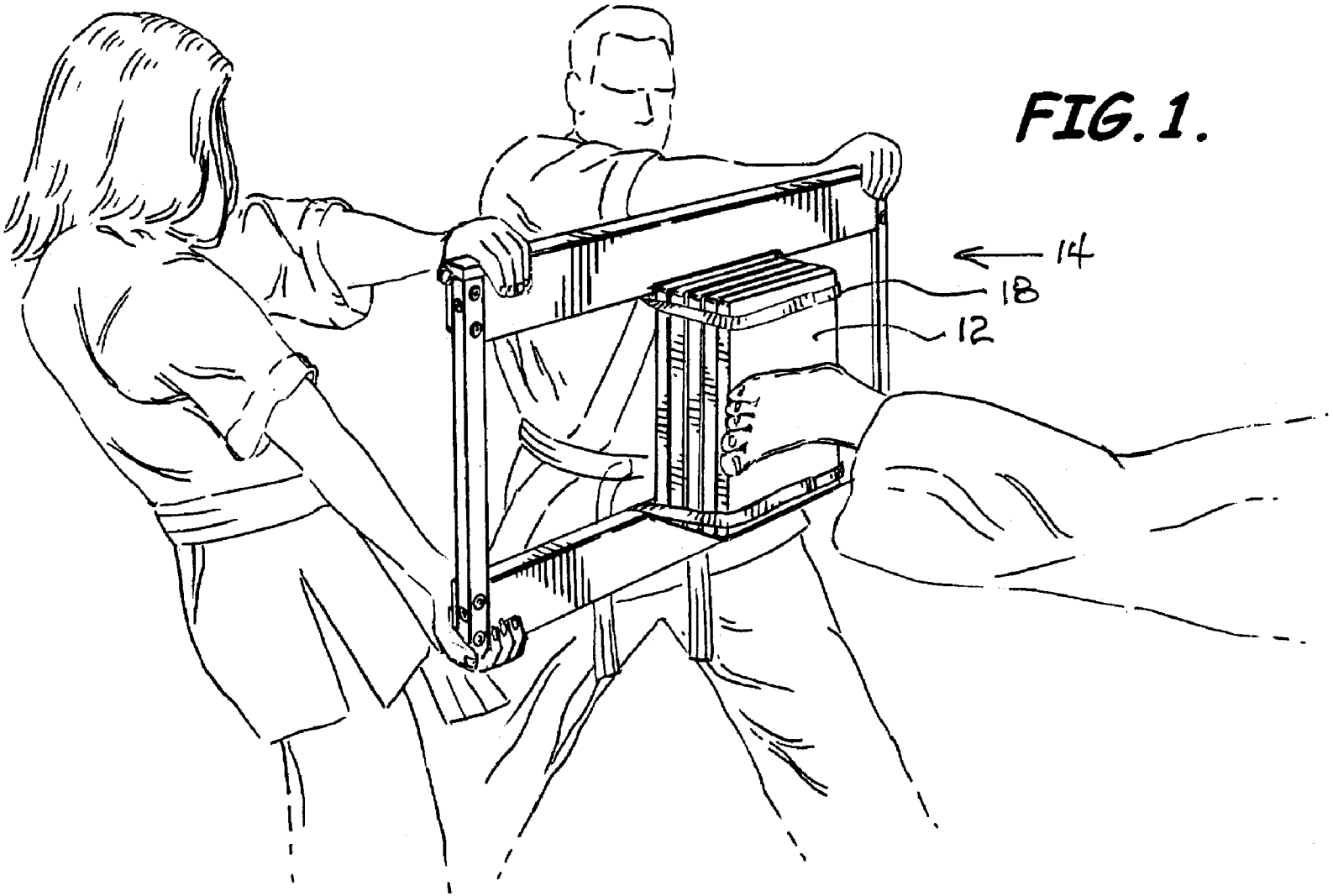
FIG. 1 is a perspective view of the device in use according to an embodiment of the present invention.
Figure 2:
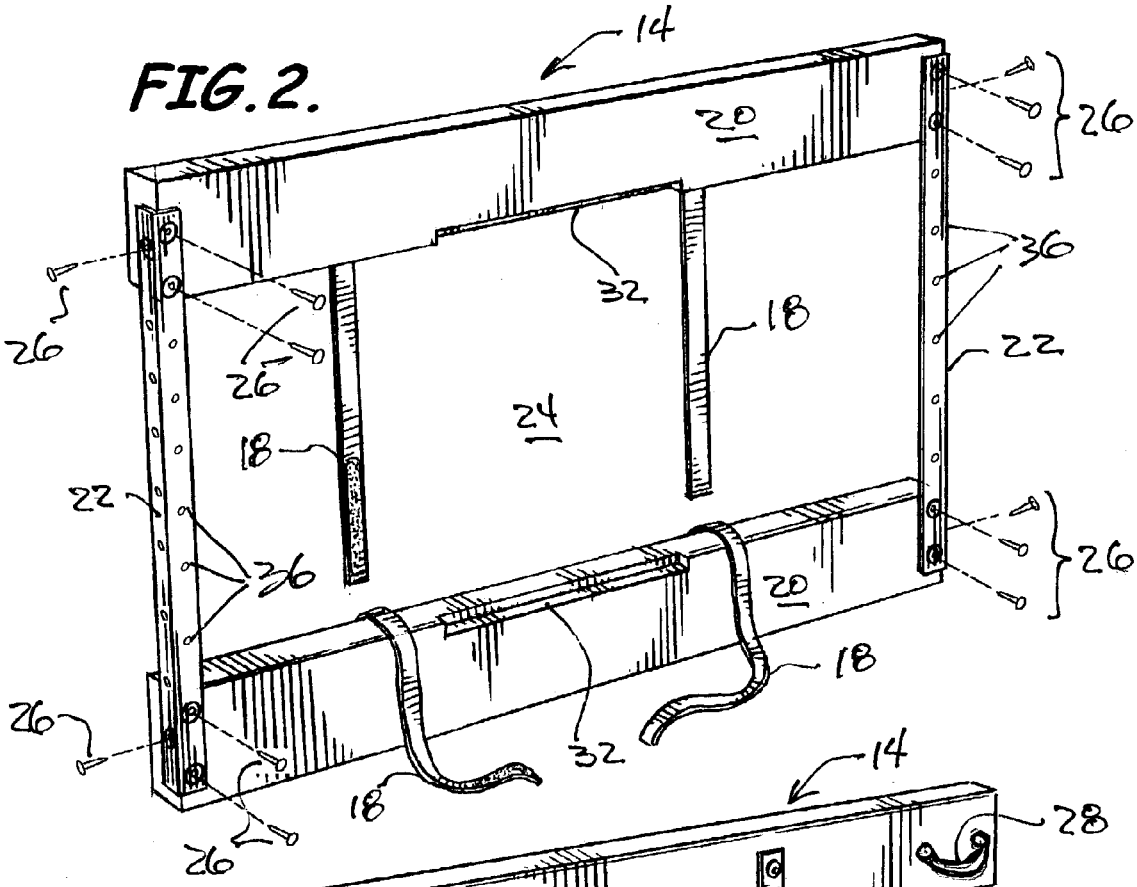
FIG. 2 is a perspective view of the device of FIG. 1 without a breaking board supported thereon.

FIGS. 1 through 6 illustrate a martial arts device for holding at least one breaking board 12. The device of the invention is primarily intended for being hand-held, as shown in FIG. 1, although the skilled will understand that the device may also be adapted for installation on a wall or other fixed support. The device of the present invention comprises a frame 14, at least two supports 16 for breaking boards, and a plurality of adjustable fasteners or straps 18. The frame 14 has at least four frame members connected to form the frame, wherein the frame members comprise generally parallel and oppositely spaced apart first and second lengthwise members 20, and generally parallel and oppositely spaced apart first and second widthwise members 22. Lateral edges of the frame members form an outside periphery and an inside periphery of the frame, the inside periphery surrounding an inside opening 24 extending through the frame. In a preferred embodiment of the invention, the frame 14 comprises an elongated substantially rectangular shape, as best shown in FIGS. 1–6. In a most preferred embodiment of the invention the frame members are detachably connected to each other so as to allow assembly and disassembly of the frame, thereby further increasing the portability of the device. The frame members may be detachably connected by removable fasteners 26, as shown in FIG. 2.

Figure 3:
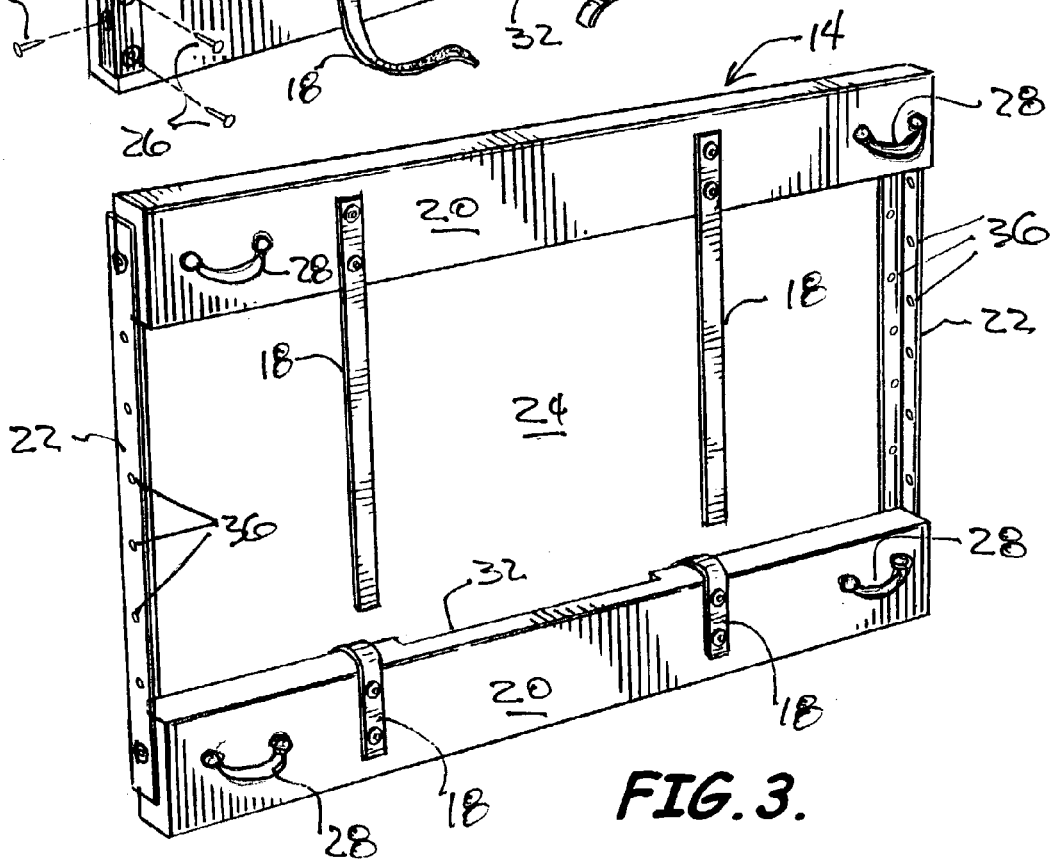
FIG. 3 shows a rear perspective view of the device of FIG. 1 showing the attachment of the fastener straps.

The device preferably also comprises a plurality of hand holds 28 for manually supporting the frame. The hand holds 28 may be the frame members themselves or formed thereon, or more preferably comprise handles connected to the frame members, especially along a rear surface of the frame member, as shown in FIG. 3, so that the hands of a holding assistant are completely behind the frame 14 and thus protected from misdirected blows. Preferably, at least two hand holds 28 are positioned adjacent lateral peripheries of the frame for manually supporting the frame, as shown.

Figure 6:
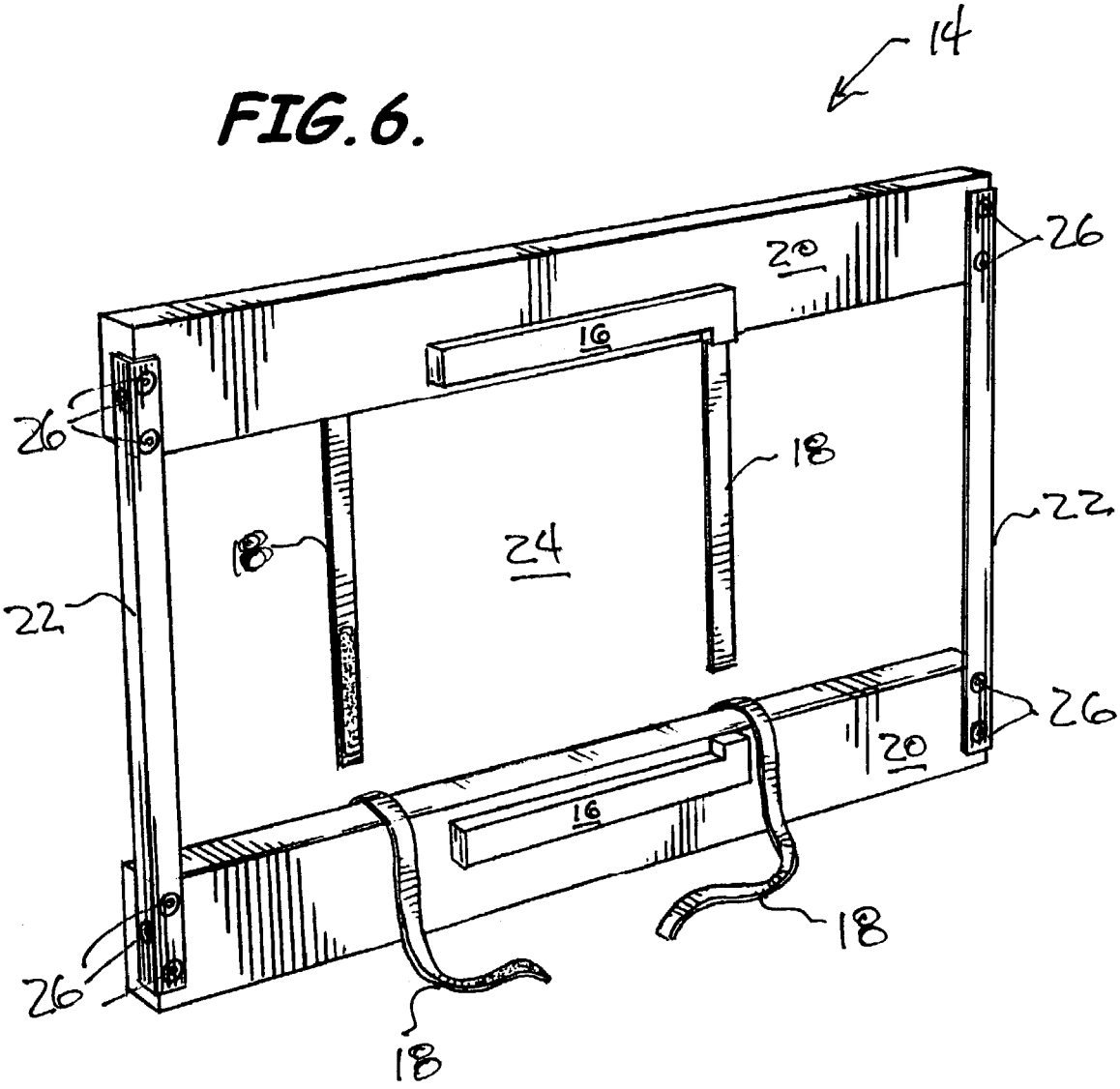
FIG. 6 is a perspective view of another preferred embodiment of the device of FIG. 1.

As seen in FIG. 6, the frame 14 also includes at least two supports 16 positioned generally spaced apart and opposite each other on the frame members adjacent the inside periphery of the frame for receiving edges of a breaking board 12 so as to support the board positioned across the inside opening of the frame. These supports 16 are best made sufficiently large to thereon support a plurality of breaking board 12 edges. Preferably, the supports are positioned on the lengthwise frame members 20, as shown.

In a most preferred embodiment of the invention, shown in FIGS. 1–5, the supports more specifically comprise at least two rabbets 32 positioned generally spaced apart and opposite each other on the frame members along the inside periphery of the frame for therein receiving edges of a breaking board 12 so as to support the board positioned across the inside opening of the frame. The skilled will recognize that a rabbet is a groove or cut along the edge of a board that receives or interlocks with another piece to form a joint. See *Webster's II New College Dictionary*, Houghton Mifflin Company, Boston and New York, 1995. The use of two rabbets 32 opposite each other along the frame members, as shown in FIGS. 1–5, allows a breaking board 12 to be nested into the frame with minimal overlap of the board over the frame member. Skilled persons will appreciate that such minimal overlap between the breaking board 12 and the frame 14 is very desirable, as a misdirected blow could fall toward the outer edges of the breaking board and if there is a large overlap the blow could actually land upon the frame itself, increasing the likelihood of injury to the martial arts practitioner. Minimal overlap between the breaking board 12 and the supporting frame 14 will reduce chances of such an occurrence.

The device of the invention additionally includes a plurality of adjustable fasteners 18 positioned on the at least four frame members adjacent the at least two supports 16, 32 for fastening the breaking board 12 to the frame. These adjustable fasteners 18 may comprise hook and loop fasteners, such as the type marketed under the trademark of Velcro®. The skilled will readily recognize, however, that the invention is intended to include any other fasteners and closures suitable for fastening the breaking boards in place on the frame of the device. Preferred fasteners include flexible straps, as illustrated in FIGS. 1–5, which include hook and loop fasteners. It should be appreciated that soft, flexible straps are desirable as they pose a smaller risk of injury to the martial arts practitioner, whereas fasteners which are rigid pose a higher risk of injury due to misdirected blows.

In one preferred embodiment, as shown in FIG. 1, the first and second lengthwise members extend sufficiently to require two persons for manually supporting the frame in mid air. That is, the rectangular frame is sufficiently elongated that one person cannot easily hold it, and it requires two assistants to manually support the frame in mid-air in preparation for board breaking by the martial arts practitioner. As seen in FIG. 1, in this manner and configuration the holding assistants are positioned well out of the way of a blow delivered toward the position of the breaking boards, and are not very likely to be injured by any misdirected blow, particularly because the board(s) are preferably centered along the frame and the assistants are at opposite ends of the elongated frame. The holding position shown in FIG. 1 is a preferred manner of holding the device, as the impact force of a blow delivered to the breaking boards passes directly onto the palms, the largest area of the hands of the holders. It should also be understood that the present invention is typically to be used with breaking boards made of natural wood, however, the invention may also preferably include a reusable breaking board. The skilled will know that such reusable breaking boards include manufactured boards which have one or more joints along which the board will separate in response to an effective blow delivered thereon.

It is to be further understood that the invention described also includes within its scope a frame 14 wherein a breaking board 12 is supported by the widthwise frame members 22 so that the breaking board extends along the lengthwise dimension of the frame. Additionally, it is intended that the invention include a frame 14 which is adjustable in size in at least one dimension. For example, as shown in FIGS. 2 and 3, the widthwise frame members 22 may include a plurality of openings 36 along their extent so that the width of the frame may be changed according to which openings are used to insert the removable fasteners 26 in assembling the frame 14. The lengthwise members 20 could also be adjustable in length in a similar manner, allowing for the frame 14 to increase or decrease in length to accommodate perhaps two sets of breaking boards fastened side-by-side in the frame. Such an arrangement would allow for double-blow practice by one practitioner, or for separate blows by two practitioners, and perhaps even simutaneous blows. The size of the frame 14 is, thus, limited only by its manageability and the length of its frame members.

The frame 14 of the device is preferably fabricated of a sturdy, relatively rigid but also somewhat resilient material to help absorb shock. In a mass manufactured model, the frame may best be constructed of a hard plastic material, which is typically very durable and rigid, while also being a bit resilient. The frame could also be made of wood and/or metal, although metal is not favored by martial arts practitioners because of its extreme rigidity and hardness, which tend to increase the chance of injury.

Method aspects of the invention include holding at least one breaking board 12 for martial arts by supporting a frame 14 having at least four frame members connected to form the frame, wherein the frame members comprise generally parallel and oppositely spaced apart first and second lengthwise members 20, and generally parallel and oppositely spaced apart first and second widthwise members 22, wherein lateral edges of the frame members form an outside periphery and an inside periphery of the frame, the inside periphery surrounding an inside opening 24 extending through the frame, wherein at least two rabbets are positioned generally spaced apart and opposite each other on the frame members along the inside periphery of the frame for therein receiving edges of a breaking board 12 so as to support the board positioned across the inside opening of the frame, and wherein a plurality of adjustable fasteners 18 is positioned on the frame members adjacent the at lea two rabbets 32. The method of the invention further comprises assembling and disassembling the frame by connecting and disconnecting the frame members from each other, preferably by using removable fasteners 26. The method further includes fastening the at least one breaking board 12 on the frame 14 by engaging edges of the breaking board with the at least two rabbets 32 and fastening the breaking board to the frame with the adjustable fasteners 18.

Additional aspects of the method of the invention include providing a plurality of hand holds 28 along frame for manually supporting the frame, and preferably forming the plurality of hand holds on the frame members. Alternatively, the method could comprise connecting a plurality of hand holds 28 to the frame members. At least one hand hold 28 may be provided adjacent a lateral periphery of the frame 14 and on a rear surface of a frame member, as shown in FIG. 3. In the method, the plurality of adjustable fasteners 18 preferably comprises hook and loop fasteners. As noted above, in the method it is preferable that the first and second lengthwise members 20 extend sufficiently to require two persons for manually supporting the frame 14 in mid air. The rabbets 32 are best made to be sufficiently deep to therein receive a plurality of breaking board 12 edges, and preferably at least two rabbets are positioned on the lengthwise frame members, as shown in FIGS. 1–5. Finally, in the method the breaking board 12 optionally comprises a reusable breaking board.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed is:

1. A portable martial arts device for holding at least one breaking board, said device comprising:

a hand-held frame having frame members connected to form said frame, wherein the frame members comprise generally parallel and oppositely spaced apart first and second lengthwise members, and generally parallel and oppositely spaced apart first and second widthwise members, wherein lateral edges of said frame members form an outside periphery and an inside periphery of said frame, the inside periphery surrounding an inside opening extending through the frame;

at least two rabbets positioned generally spaced apart and opposite each other on edges of said frame members along the inside periphery of said frame for therein receiving edges of a breaking board so as to support the board positioned across the inside opening of the frame; and a plurality of flexible fasteners positioned on said frame members adjacent said at least two rabbets for fastening said breaking board on said frame.

2. The device of claim 1, wherein said frame members are detachably connected so as to allow assembly and disassembly of the frame.

3. The device of claim 2, further comprising removable fasteners connecting said frame members.

4. The device of claim 2, wherein at least two of said detachably connected frame members further include a plurality of openings for thereby making the detachable connection adjustable to vary the frame size.

5. The device of claim 1, further comprising a plurality of hand holds for manually supporting the frame.

6. The device of claim 5, wherein said plurality of hand holds comprises hand holds formed on said frame members.

7. The device of claim 1, wherein said plurality of hand holds comprises a plurality of handles connected to said frame members.

8. The device of claim 1, further comprising at least one hand hold adjacent a lateral periphery of said frame.

9. The device of claim 1, wherein said plurality of flexible fasteners comprises hook and loop fasteners.

10. The device of claim 1, wherein said first and second lengthwise members extend sufficiently to require two persons for manually supporting said frame in mid air when holding the frame by said first and said second widthwise members.

11. The device of claim 1 wherein said at least two rabbets are sufficiently deep to therein receive a plurality of breaking board edges.

12. The device of claim 1, wherein said at least two rabbets are positioned on said lengthwise frame members.

13. The device of claim 1, wherein said breaking board comprises a reusable breaking board.

14. A portable martial arts device for holding at least one breaking board, said device comprising:

a hand-held frame having at least four frame members connected to form said frame, wherein the at least four frame members comprise generally parallel and oppositely spaced apart first and second lengthwise members, and generally parallel and oppositely spaced apart first and second widthwise members, wherein lateral edges of said at least four frame members form an outside periphery and an inside periphery of said frame, the inside periphery surrounding an inside opening extending through the frame;

at least two supports positioned generally spaced apart and opposite each other on said at least four frame members adjacent the inside periphery of said frame for receiving edges of a breaking board so as to support the board positioned across the inside opening of the frame; and a plurality of straps positioned on said at least four frame members adjacent said at least two supports for fastening said breaking board on said frame.

15. The device of claim 14, wherein said at least four frame members are detachably connected so as to allow assembly and disassembly of the frame.

16. The device of claim 15, further comprising removable fasteners connecting said at least four frame members.

17. The device of claim 15, wherein at least two of said detachably connected frame members further include a plurality of openings for thereby making the detachable connection adjustable to vary the frame size.

18. The device of claim 14, further comprising a plurality of hand holds for manually supporting the frame.

19. The device of claim 18, wherein said plurality of hand holds comprises hand holds formed on said frame members.

20. The device of claim 14, wherein said plurality of hand holds comprises a plurality of handles connected to said frame members.

21. The device of claim 14, further comprising at least one hand hold adjacent a lateral periphery of said frame.

22. The device of claim 14, wherein said plurality of straps comprises hook and loop fasteners.

23. The device of claim 14, wherein said first and second lengthwise members extend sufficiently to require two persons for manually supporting said frame in mid air when holding the frame by said first and said second widthwise members.

24. The device of claim 14, wherein said at least two supports are sufficiently large to thereon support a plurality of breaking board edges.

25. The device of claim 14, wherein said at least two supports are positioned on said lengthwise frame members.

26. The device of claim 14, wherein said breaking board comprises a reusable breaking board.

27. A method of holding at least one breaking board for martial arts, the method comprising:

supporting a hand-held frame having at least four frame members connected to form said frame, wherein the at least four frame members comprise generally parallel and oppositely spaced apart first and second lengthwise members, and generally parallel and oppositely spaced apart first and second widthwise members, wherein lateral edges of said at least four frame members form an outside periphery and an inside periphery of said frame, the inside periphery surrounding an inside opening extending through the frame, wherein at least two rabbets are positioned generally spaced apart and opposite each other on said frame members along the inside periphery of said frame for therein receiving edges of a breaking board so as to support the board positioned across the inside opening of the frame, and wherein a plurality of soft fasteners are positioned on said frame members adjacent said at least two rabbets; and fastening the at least one breaking board on the frame by engaging edges of the breaking board with the at least two rabbets and fastening the breaking board to the frame with the soft fasteners.

28. The method of claim 27, further comprising assembling and disassembling the frame by connecting and disconnecting said at least four frame members from each other.

29. The method of claim 28, further comprising removable fasteners.

30. The method of claim 28, wherein at least two of said frame members further include a plurality of openings for thereby connecting and disconnecting, so as to make the detachable connection adjustable to vary the frame size.

31. The method of claim 27, further comprising providing a plurality of hand holds along the frame for manually supporting the frame.

32. The method of claim 31, further comprising forming the plurality of hand holds on the frame members.

33. The method of claim 27, further comprising connecting a plurality of handles to the frame members.

34. The method of claim 27, further comprising at least one hand hold adjacent a lateral periphery of said frame.

35. The method of claim 27, wherein said plurality of soft fasteners comprises hook and loop fasteners.

36. The method of claim 27, wherein said first and second lengthwise members extend sufficiently to require two persons for manually supporting said frame in mid air when holding the frame by said first and said second widthwise members.

37. The method of claim 27, wherein said at least two rabbets are sufficiently deep to therein receive a plurality of breaking board edges.

38. The method of claim 27, wherein said at least two rabbets are positioned on said lengthwise frame members.

39. The method of claim 27, wherein said breaking board comprises a reusable breaking board.

* * * * *